United States Patent [19]

Smith

[11] 4,391,466

[45] Jul. 5, 1983

[54] WATER CHAIR

[76] Inventor: Peter A. Smith, 102 Evelyn St., Sylvania 2224, N.S.W., Australia

[21] Appl. No.: 231,970

[22] Filed: Feb. 6, 1981

[51] Int. Cl.[3] ..... A47C 7/02; A47C 7/36

[52] U.S. Cl. ..... 297/452; 297/416; 297/DIG. 3

[58] Field of Search ..... 297/452, 455, 456, DIG. 3, 297/416; 5/451

[56] References Cited

U.S. PATENT DOCUMENTS

| | | | |
|---|---|---|---|
| 779,576 | 1/1905 | Berryman | 5/451 |
| 3,330,598 | 7/1967 | Whiteside | 297/456 |
| 3,408,107 | 10/1968 | Savage | 297/456 |
| 3,519,308 | 7/1970 | Kasman et al. | 297/452 |
| 3,614,156 | 10/1971 | Sarvas | 297/416 |
| 3,841,701 | 10/1974 | Sullivan | 297/416 |
| 4,108,492 | 8/1978 | Kirby | 297/DIG. 3 |
| 4,143,909 | 3/1979 | McFarlin | 5/451 |
| 4,189,181 | 2/1980 | Noble | 297/455 |

*Primary Examiner*—Francis K. Zugel

*Attorney, Agent, or Firm*—Ostrolenk, Faber, Gerb & Soffen

[57] ABSTRACT

A chair is disclosed, with a plurality of water bags on the chair serving as the cushion on the back support. The bags are layered down along the back support. Each bag is supported in a sling whose upper margin is attached to the back support. The seat cushion of the chair is also a water bag.

7 Claims, 7 Drawing Figures

WATER CHAIR

BACKGROUND OF THE INVENTION

The present invention relates to a chair which will hereinafter be referred to, for convenience, as a "water chair".

The so-called "water bed" which is characterized by use of a water impermeable bag or mattress filled with water is known. Such a bed has unique comfort characteristics attributed to the fluid nature of water. Also, the water can be heated, if desired, and retains the heat for a significant period of time.

It has been proposed that a chair could be made utilising a water filled seat and back support on a similar principle. However, whilst in the case of a water bed the problem of making a water filled mattress has been successfully overcome in making a water chair special problems arise.

The main difficulty resides in making a water filled back support which will retain the required shape. Whereas a water filled mattress for a bed is disposed horizontally in use and therefore largely self-supporting, a back support cushion for a chair is not so disposed and previous attempts to make a water filled back support for a chair have failed owing to the tendency for water to settle to the bottom part of the cushion resulting in a sagging effect or in the impossibility of maintaining the cushion in its desired shape.

It will be evident, for example, that a loosely mounted, water filled cushion would be impracticable for a back support for a chair since it is not possible to provide at the same time the fluid characteristics of the water and the degree of rigidity necessary to make the cushion self-supporting. Attempts to overcome this problem by fastening a water filled bag to the back supporting portion of a chair frame have failed because of the tendency of the water to settle at the bottom, which gives rise to unsatisfactory bag shape and therefore inadequate back support.

The present invention is directed towards overcoming the problems of the prior art.

SUMMARY OF THE INVENTION

In its broadest form, the present invention resides in a chair for one or more persons, comprising a frame, a seating portion and a back supporting portion being defined by the frame, and at least one cushion arranged to be filled with water, said at least one cushion being secured to the back supporting portion of the chair and arranged and disposed whereby in use of the chair said cushion supports the back of said one or more persons.

In the preferred form of this invention, two or more such cushions are secured to the back supporting portion of the frame along respective upper margins of the cushions, with a lower portion of one cushion resting on an upper portion of the cushion below it. A head rest may be provided above the uppermost cushion.

Conveniently each cushion comprises a water filled bag carried within a covering or "sling", with the latter being fixed to the back supporting portion of the frame. Preferably the sling fully encloses the bag but has an opening for inserting the bag into or removing the bag from the sling when desired. Such an opening could be closed by means of, for example, a zipper and may be located at the front, back or one of the sides of the sling.

Preferably the seating portion of the chair is also provided with a water filled cushion which may be loosely mounted on the seating portion of the frame. The seating portion of the frame could be recessed to accommodate the cushion.

In one embodiment of the invention arm rests are provided which are detachably mounted to the sides of the seat. This detachability has been found to be convenient for reducing the effective width of some embodiments of the chair to allow them to be easily moved through doorways.

BRIEF DESCRIPTION OF THE DRAWINGS

A preferred embodiment of the invention will now be described with reference to the accompanying drawings in which.

DETAILED DESCRIPTION OF PREFERRED EMBODIMENT

Figure 1:
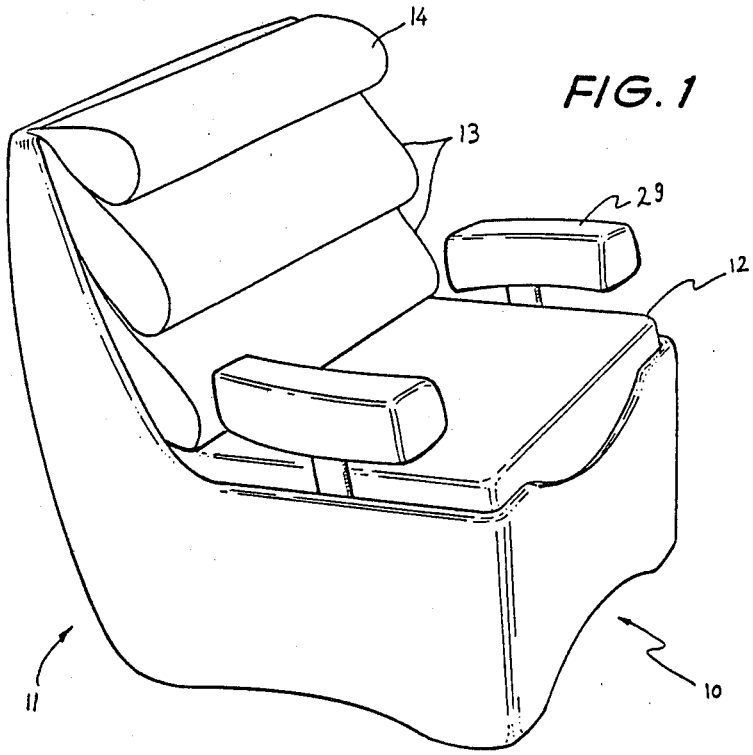
FIG. 1 is a perspective view of a chair embodying the invention.

The chair shown in FIG. 1 of the drawings comprises a frame defining generally a seat portion 10 and a back supporting portion 11. The chair includes a seat cushion 12 and a number of back supporting cushions 13. A head rest 14 extends along the top of the back supporting portion 11, above the back supporting cushions 13.

Figure 2:
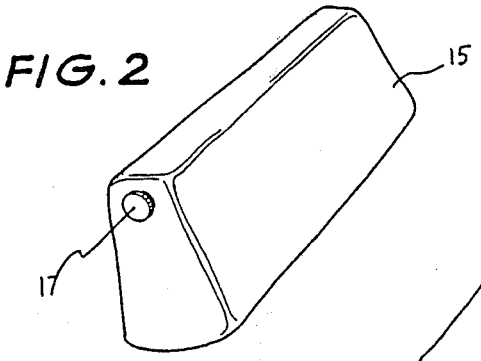
FIG. 2 shows a water bag for use in a back supporting cushion for the chair.
Figure 3:
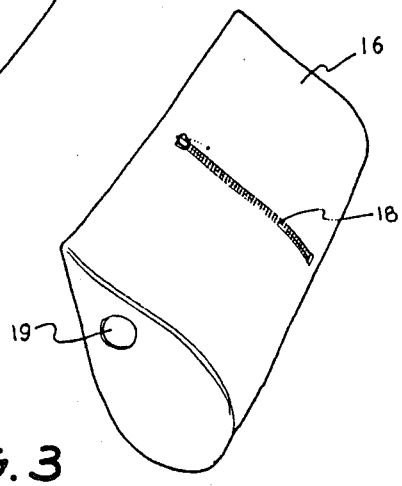
FIG. 3 shows a sling support for the water bag of FIG. 2.

The back supporting cushions 13 comprise water containing bags 15 as shown in FIG. 2 carried within sling supports 16 shown in FIG. 3. The bags 15 are roughly triangular in cross sectional shape and extend substantially the width of the chair. A fill opening 17 for water is provided at one end of the bag, and this is closed by means of a stopper. The sling 16 is made from a suitable fabric into a shape to fully enclose and support the water impermeable bag 15. An opening is provided at the front of the sling for inserting the bag into or removing the bag from the sling when desired. A zipper 18 is used for closing the opening. Another opening 19 is provided at the side of the sling adjacent the fill opening of the bag to allow the bag to be filled without having to remove it from the sling.

Figure 7:
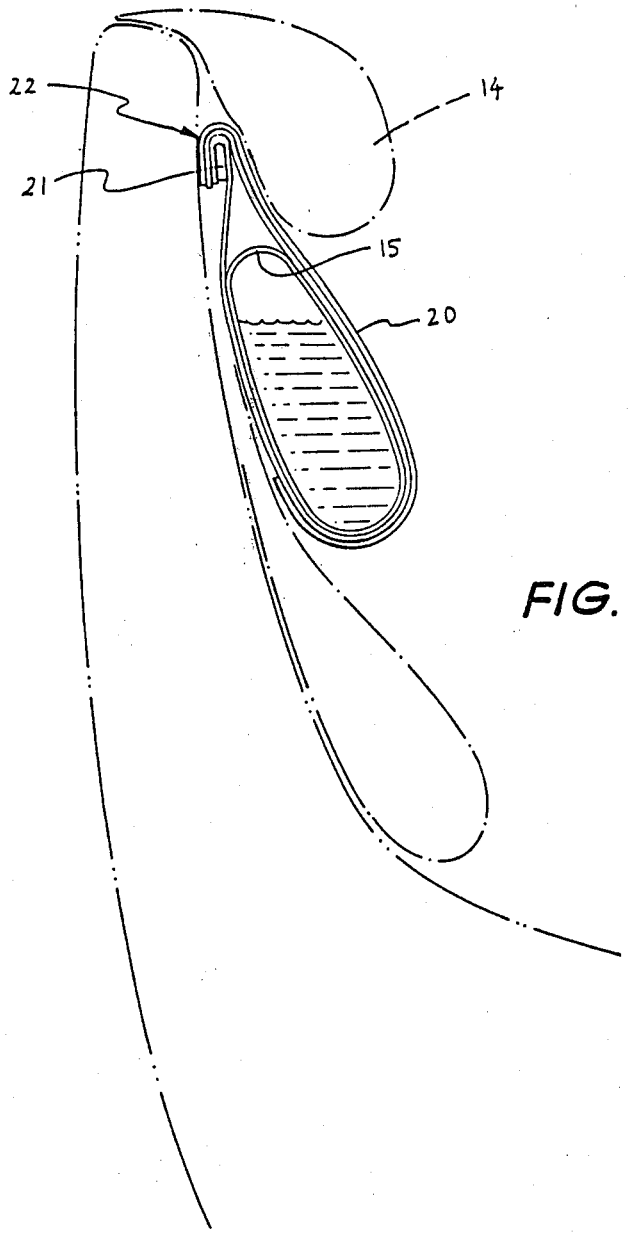
FIG. 7 is a section showing a back supporting cushion attached to a chair frame.

A cover (FIG. 4) 20 slips over the outside of the sling. The cover, which is made from suitable fabric, extends from an upper margin over the front of the sling and around the lower portion and terminates behind the cushion. As shown more clearly in FIG. 7, the cover and the sling are secured along their upper margins to the back supporting portion of the chair frame by tacks or other suitable means and a timber strip 21 is nailed over the overlapping top margins 22 of the cover and sling. As also seen from FIG. 7, each of the water filled cushions is effectively suspended from its upper edges and assumes a natural shape under its own weight resembling somewhat a tear-shaped drop in cross section. This fact is utilised in the preferred embodiment of the invention in which the lower part of the upper water filled cushion rests on the upper part of the lower cushion. Similarly a head rest or cushion 14 partly overlies the upper water filled cushion whereby the head rest, together with the two water filled cushions, form a comfortably contoured three-ribbed back support.

Figure 5:
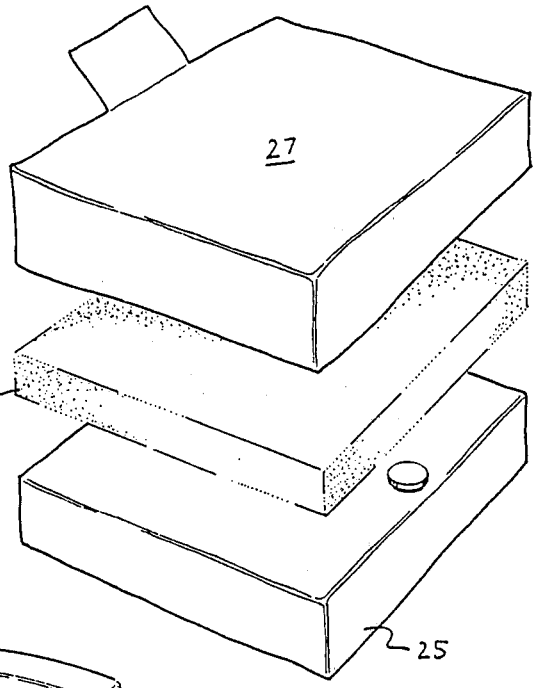
FIG. 5 is an exploded view of a chair seating cushion and cover.
Figure 6:
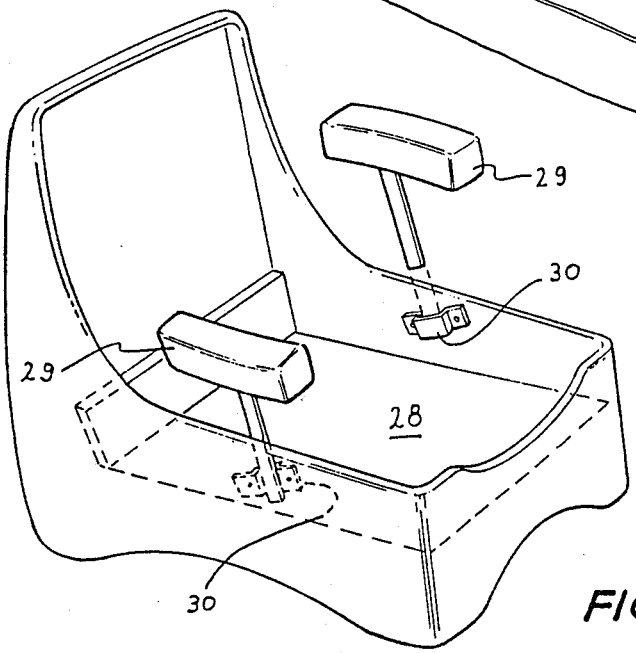
FIG. 6 is a perspective view of a chair frame.

FIG. 5 shows in exploded view the seat cushion structure, which comprises a water bag 25 covered with a foam insulating layer or pad 26 and a cover 27 fitted over the layer 26 and the water bag 25. As shown in FIG. 6, the frame of the chair is formed with a recessed portion 28 which accommodates the water filled cushion for the seat. The water filled cushions may be electrically heated if desired.

Arm rests 29 are detachably mounted through sockets 30 to the sides of the chair frame and can readily be removed if desired.

Figure 4:
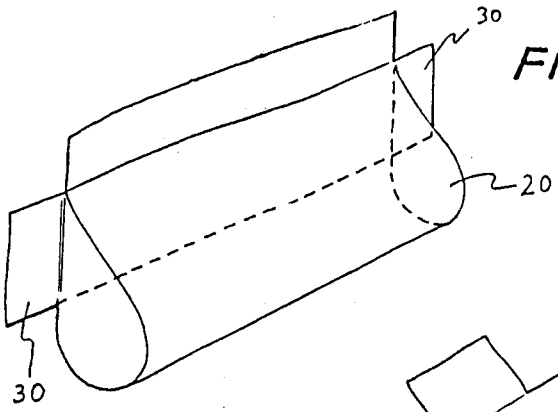
FIG. 4 shows a cover for the cushion.

Any suitable materials for the chair frame and cushions may be used. For example, the frame may be constructed principally of timber and fabric material may be used for the covering material for the chair. The cushion covers 20 such as shown in FIG. 4 may include side flaps 30 which can be tucked behind the cushion to give a neat outward appearance. The slings 16 are preferably made of tough flexible material, while the bags 15 should be resistant to tearing and should be water impermeable. The chair may be mounted on castors for mobility.

The invention is not limited to the embodiment illustrated in the drawings but may extend to other kinds and shapes of chairs, either for one person or for a number of persons. Preferably the head rest is of conventional material such as synthetic foam.

I claim:

1. A chair for one or more persons, comprising a frame, a seating portion and a back supporting portion being defined by the frame, the chair back comprising a plurality of cushions arranged to be partially filled with water, a corresponding plurality of slings, each sling being attached along an upper margin of the back supporting portion; each cushion comprising a water impermeable bag carried within a sling, the bag being partially filled with water, the plurality of cushions being mounted one above the other to the back supporting portion of the frame, with the lowermost part of one cushion resting on the uppermost part of the cushion below it, whereby in use of the chair said cushion supports and adapts itself to the shape of the back of said one or more persons.

2. A chair as claimed in claim 1, wherein each bag is provided with a fill opening and a stopper for the opening, and wherein each sling comprises a covering for the bag and is provided with an opening for access to the fill opening of its respective bag.

3. A chair as claimed in claim 2, wherein each sling has a flap extending along a top margin of the sling, the flap being secured to the back supporting portion of the frame and the remainder of the sling, together with the bag carried therein, being suspended from the flap.

4. A chair as claimed in claim 1, wherein a head rest portion is attached to the back supporting portion of the frame above the uppermost cushion, the head rest portion having a construction similar to that of the uppermost cushion.

5. A chair as claimed in claim 1, wherein the seating portion comprises at least one seating cushion filled with or arranged to be filled with water.

6. A chair as claimed in claim 1, wherein the sling is in the form of a closed covering for the bag and has an opening for inserting the bag into or removing the bag from the covering, and fastening means for closing said opening in the sling.

7. A chair as claimed in claim 1 and comprising an outer removable covering for each cushion, the outer covering comprising a flexible portion arranged to cover a major part of the cushion, extending from a top margin thereof over the front of the cushion and around a lower portion of the cushion and terminating behind the cushion, so as to cover all otherwise visible portions of the cushion; said outer covering including a top flap extending along a top margin of the covering and secured to the back supporting portion of the frame.

* * * * *